US007213987B2

(12) United States Patent
Manduley

(10) Patent No.: US 7,213,987 B2
(45) Date of Patent: May 8, 2007

(54) SYNCHRONIZATION METHOD AND APPARATUS IN A VALUE METERING SYSTEM HAVING A DIGITAL PRINT HEAD

(75) Inventor: Flavio M. Manduley, Woodbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 1318 days.

(21) Appl. No.: 09/732,530

(22) Filed: Dec. 8, 2000

(65) Prior Publication Data

US 2004/0215582 A1 Oct. 28, 2004

(51) Int. Cl.
*B41J 11/44* (2006.01)

(52) U.S. Cl. ..... 400/76; 400/88; 400/641; 347/104

(58) Field of Classification Search ..... 101/66, 101/71, 93.09, 93.24, 93.25, 212; 400/279, 400/283, 292, 303, 306, 306.2, 307, 545; 705/408

See application file for complete search history.

(56) References Cited

U.S. PATENT DOCUMENTS 3,644,806 A * 2/1972 Belson et al. ..... 318/7
3,917,048 A * 11/1975 Riley ..... 400/616.1
4,168,533 A 9/1979 Schwartz
4,872,119 A * 10/1989 Kajimoto ..... 705/402
4,971,466 A * 11/1990 Kondo ..... 400/577
5,122,967 A * 6/1992 Gilham ..... 700/235
5,408,416 A * 4/1995 Gilham ..... 705/406
5,608,636 A * 3/1997 Guenther ..... 705/408

FOREIGN PATENT DOCUMENTS

EP 0298775 A2 * 1/1989
JP 58-42482 A * 3/1983

OTHER PUBLICATIONS

Costlow: "Plotters push print speed"; Electronic Engineering Times, Feb. 17, 1992, p. 63.*

* cited by examiner

*Primary Examiner*—John G. Weiss
*Assistant Examiner*—Michael Fisher
(74) *Attorney, Agent, or Firm*—Ronald Reichman; Angelo N. Chaclas

(57) ABSTRACT

A manually activated, value-metering system having a method and an apparatus for achieving synchronization, wherein the value metering system uses a digital print head to print a plurality of printed lines, one printed line at a time, on a substrate, which is advanced through a print zone of the print head in a moving direction. A mechanical restraint is used to restrict the movement of the substrate through the print zone such that the substrate is allowed to move a fixed distance after the print head has printed one printed line until the last is printed. The fixed distance is substantially equal to the width of one printed line.

16 Claims, 9 Drawing Sheets

SYNCHRONIZATION METHOD AND APPARATUS IN A VALUE METERING SYSTEM HAVING A DIGITAL PRINT HEAD

FIELD OF THE INVENTION

The present invention relates generally to a value metering system and, more particularly, to a postage meter having a digital print head to print a pattern of substrates one line at a time.

BACKGROUND OF THE INVENTION

Manually-activated postage meters are well-known in the art. Typically, an envelope or a tape is manually fed under a print head for printing an indicium thereon. The print head is fixedly mounted in the postage meter, and a sensing device is used to sense the presence of the envelope under the print head. In order to print the indicium with minimum distortion, the speed of the envelope must be controlled to match the print speed of the print head. Thus, some mechanism must be used to synchronize the movement of the envelope to the print head. U.S. Pat. No. 4,168,533 (Schwartz) discloses a micro-computerized miniature postage meter, wherein a microcomputer is used to actuate an inkjet printing device to project ink droplets onto a substrate moving relative to the printing device. In particular, the movement of the printing device relative to the substrate is detected by an encoded rotating wheel mounted on the lower contact surface of the printing device. The rotating wheel is coupled to an interrupter disc, which is adapted to provide signal pulses for coordinating the proper time for actuating of the printing device. With such a design, the postage meter becomes costly to produce and to sell.

Thus, it is advantageous and desirable to provide a simple synchronization method and apparatus for use in a value metering system, such as a postage meter.

SUMMARY OF THE INVENTION

The first aspect of the present invention is an apparatus for achieving synchronization in a value metering system. In particular, the value metering system uses a digital print head capable of printing a plurality of printed lines on a substrate, which is displaced relative to the print head in a moving direction, wherein the lines are substantially perpendicular to the moving direction, and a first signal is provided after a line is printed. The apparatus comprises:

a first mechanism operable at a first position to restrict the displacement of the substrate and a second position to effectively disengage from the substrate, wherein the first mechanism is operated at the first position while the print head is printing a line; and a second mechanism, responsive to the first signal, for causing the first mechanism to operate at the second position, thereby allowing the displacement of the substrate by a predetermined distance relative to the print head for printing a next line.

Preferably, the apparatus further comprises a third mechanism, responsive to the displacement of the substrate, for providing a second signal, indicative of the displacement of the substrate by the predetermined distance for causing the print head to print the next line. The third mechanism can be an optical sensor, a mechanical sensor, or the like.

Preferably, a third signal, indicative of a last printed line, is provided for preventing the first mechanism from further operating at the first position after the last line is printed.

Preferably, the substrate is manually displaced, but it is possible that the substrate is displaced by a movement device.

The second aspect of the present invention is a method of achieving synchronization in a value metering system using a digital print head capable of printing a plurality of lines, one line at a time, on a substrate which is displaced in a moving direction relative to the print head, wherein the lines are substantially perpendicular to the moving direction. The method comprises the steps of:

engaging the substrate with a first mechanism capable of restricting the displacement of the substrate while the print head is printing a line;

providing a first signal indicating said line is printed;

disengaging the first mechanism from the substrate in response to the first signal; and displacing the substrate by a predetermined distance for printing a next line.

Preferably, the method further comprises the step of providing a second signal indicative of the displacement of the substrate by the predetermined distance for causing the print head to print the next line, wherein the predetermined distance is substantially equal to the width of the lines or proportional to the width of the lines.

Preferably, the method further comprises the step of preventing the first mechanism from further restricting the displacement of the substrate after a last line is printed.

The third aspect of the present invention is a value metering system for printing a substrate. The value metering system comprises:

a digital print head capable of printing a plurality of lines, one line at a time, on the substrate, wherein the substrate is displaced relative to the print head in a moving direction;

a first mechanism capable of operating at a first position to restrict the displacement of the substrate and a second position to disengage from the substrate, wherein the first mechanism is operating at the first position when the print head prints a line;

a second mechanism, responsive to said printing, for providing a first signal indicating said line is printed; and a third mechanism, responsive to the first signal, for causing the first mechanism to operate at a second position, thereby allowing the displacement of the substrate by a predetermined distance for printing a next line.

Preferably, the value metering system also includes a fourth mechanism, responsive to the displacement of the substrate by the predetermined distance, for causing the print head to print the next line.

Preferably, the value metering system also includes a fifth mechanism, operatively connected to the print head for preventing the first mechanism from further operating at the first position after a last line is printed.

The value metering system can be a countertop system or a hand-held system.

It is possible that the substrate is manually displaced, but it is also possible that the substrate is displaced by a movement device.

The present invention will become apparent upon reading the description taken in conjunction with FIGS. 1 to 7.

DETAILED DESCRIPTION

Figure 1:
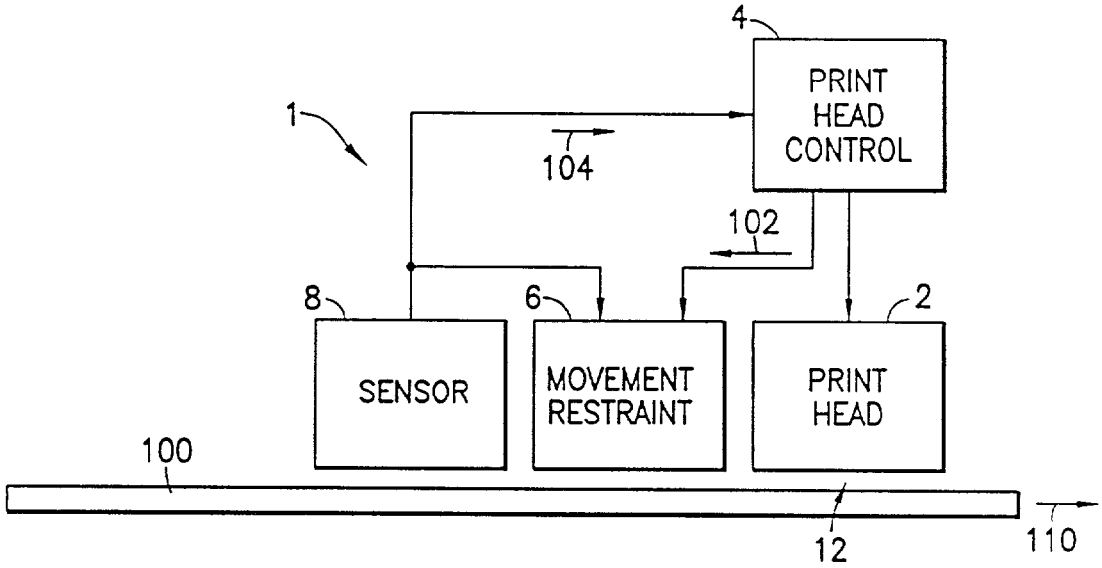
FIG. 1 is a diagrammatic representation illustrating the principle of synchronizing the printing speed of a print head and the displacement of a substrate to be printed, according to the present invention.
Figure 2:
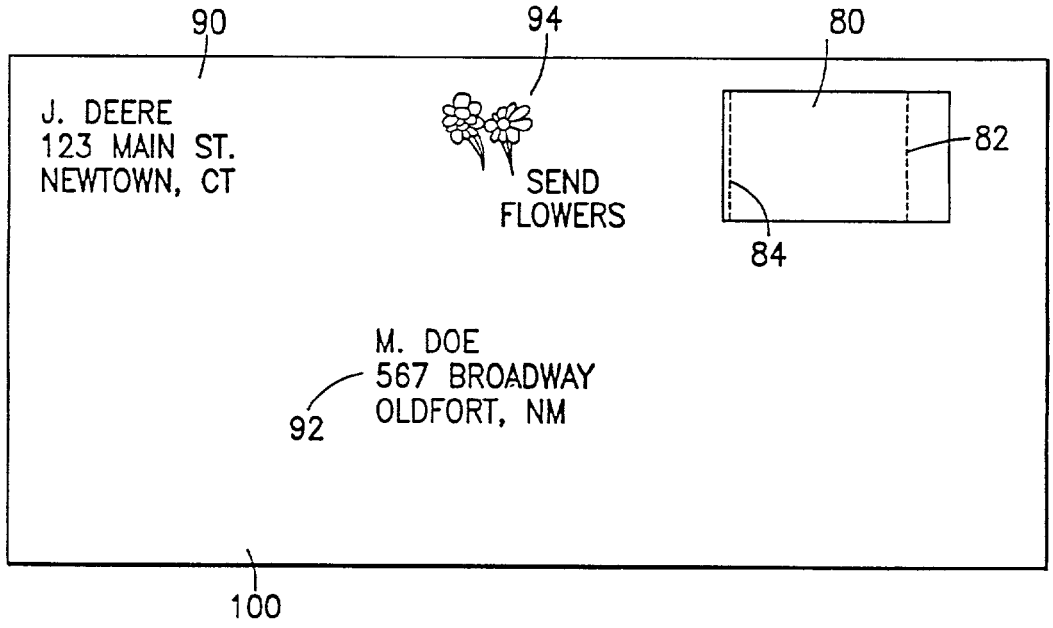
FIG. 2 is a diagrammatic representation illustrating a postage indicium and a print line on substrate.

The general principle of synchronizing the print speed and the movement of the substrate, according to the present invention, is shown in FIG. 1. As shown, synchronization system 1 includes mainly four components: print head 2, print-head control 4, movement restraining means 6 and sensor 8. System 1 can be used on a variety of value metering systems for synchronization. In particular, FIG. 1 shows a postage meter for printing text or images on a mailpiece, which is herein referred to as a substrate. However, the value metering system can be a ticket printer to produce tickets for a concert, for a sporting event, or other gathering. The value metering system can also be used to print coupons or other value-redeemable items. Basically, movement restraining means 6 is used to restrict the movement of substrate 100, such as an envelope or a tape, to be printed by print head 2 at print zone 12 in postage meter. The movement of substrate 100 is relative to print head 2 and is denoted by arrow 110. Thus, print head 2 can be located at a fixed location in the postage meter, and substrate 100 is advanced along direction 110, as in a desk-top postage meter. It is also possible to move print head 2 against a stationary substrate 100 in a direction opposite to the arrow 110 (see FIG. 3), as in a hand-held postage meter. It is understood that print head 2, under the control of print head control 4, is capable of printing a plurality of lines, one or more lines at a time. The printed lines are substantially perpendicular to moving direction 100, as shown in FIG. 2. The movement of substrate 100 is restricted during the printing of line 82 in indicium 80 or in other image or text by print head 2. After a line is printed, print head control 4 sends signal 102 to release movement restraining means 6, allowing substrate 100 to advance to the next print line position. After substrate 100 is moved to the next print line position, sensor 8 sends a signal 104 to movement restraining means 6 and print head control 4. Responsive to signal 104, movement restraining means 4 again restricts movement of substrate 100, and print head control 4 signals print head 2 to print a new line, until last line 84 is printed. It should be understood that print head 2 can also be used to print return address 90, mailing address 92 and message 94, as shown in FIG. 2.

Figure 3:
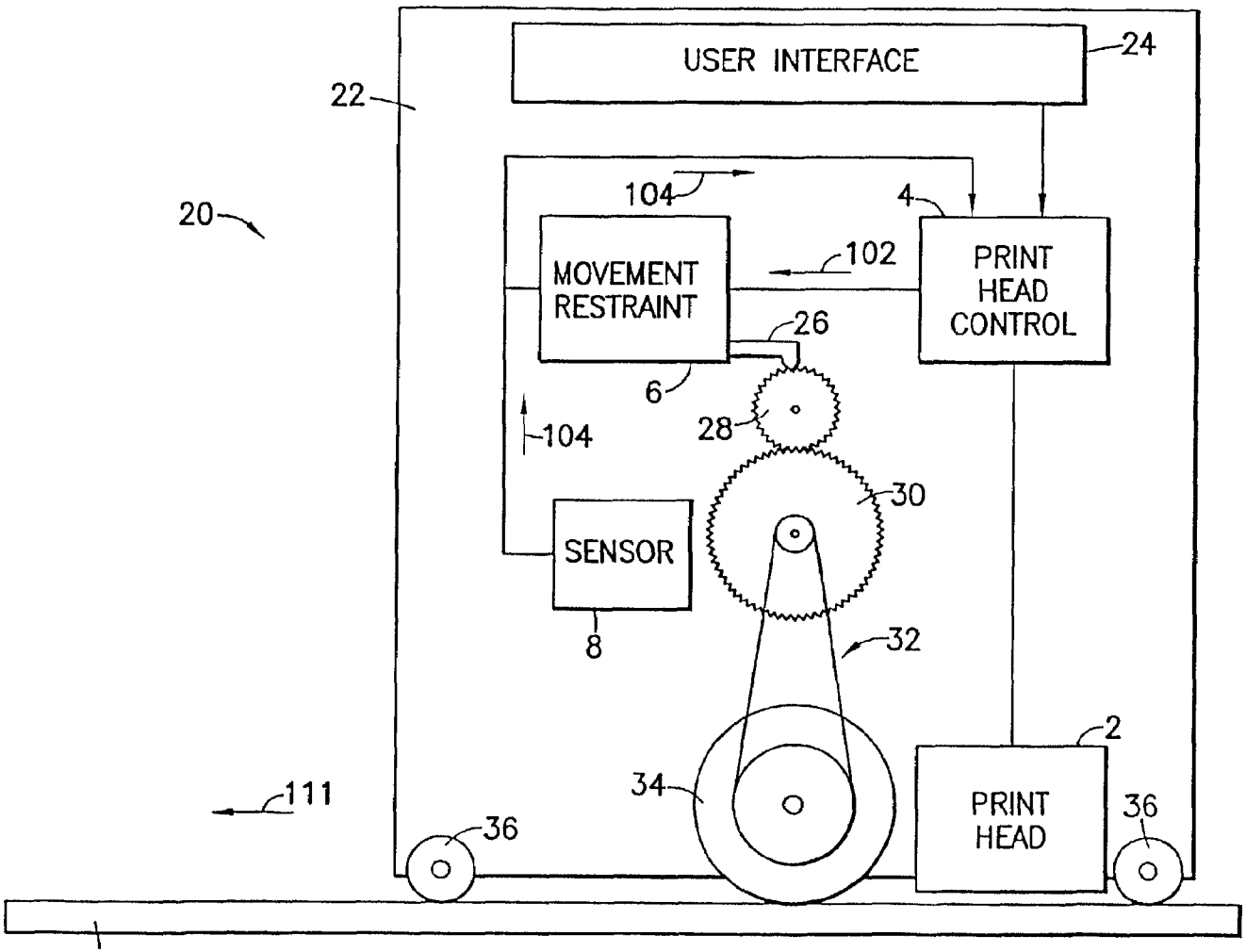
FIG. 3 is a diagrammatic representation illustrating a hand-held postage meter.

FIG. 3 is a diagrammatic representation illustrating hand-held postage meter 20. As shown, hand-held postage meter 20 has housing 22 to include the components for printing indicium 80 or other text or image on substrate 100, and the components for assisting or restricting the movement of postage meter 20 against substrate 100. As shown, housing 22 includes user interface section 24 for allowing a user to specify the data to be printed and to start the printing process. User interface section 24 is operatively connected to print head control 4 for conveying data thereto. Movement restraining means 6 is operatively engaged with latch 26, which is capable of stopping gear 28 from turning. A plurality of rollers 34, 36 is used to assist the movement of postage meter 20 long direction 111. Roller 34 is mechanically coupled to gear 30 via pulley system 32 and gear 30 is mechanically engaged with gear 28. It is understood that when a user presses down postage meter 20 against substrate 100 while the user moves postage meter 20 along direction 111, roller 34 rotates. Accordingly, gears 28, 30 also rotate if latch 26 is not restricting the rotation of gear 28. Sensor 8, which can be an optical interrupter, a mechanical switch, or the like, is used to sense the relative displacement of postage meter 20 to substrate 100. For example, sensor 8 can be arranged to sense the movement of the teeth of gear 30 such that when the rotation of roller 34 is equal to the width of one printed line by print head 2, sensor 8 sends signal 104 to movement restraining means 6. Movement restraining means 6 can include, for example, a push-pull solenoid, which pushes down latch 26 to restrict the movement of gear 28 upon receiving signal 104. The engagement of latch to gear 28 is released after a new line is printed by print head 2, as indicated in signal 102 sent by print head control 4.

Figure 4:
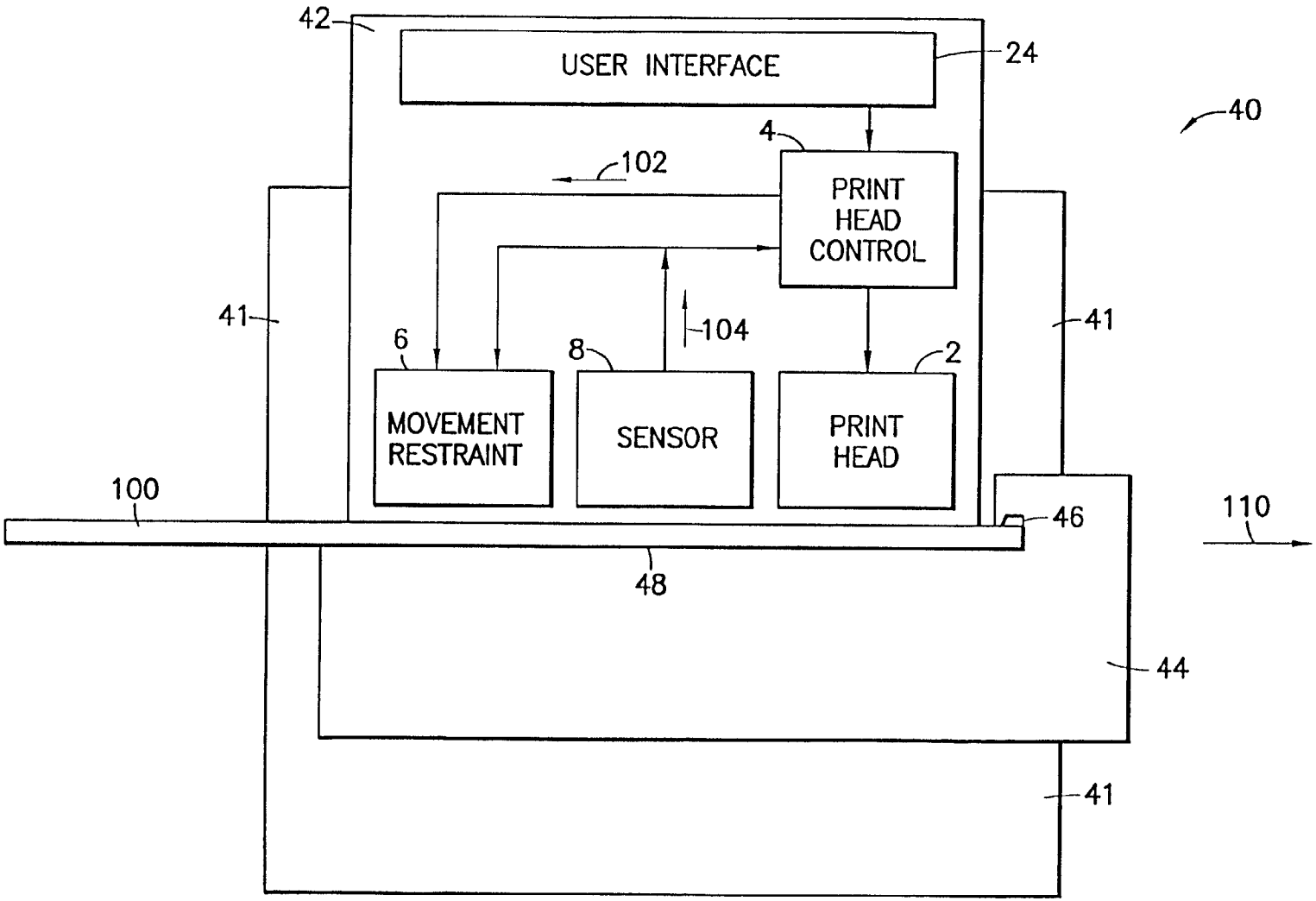
FIG. 4 is a diagrammatic representation illustrating a manually activated postage meter, wherein the substrate is manually displaced relative to the print head.

FIG. 4 is a diagrammatic representation of manually activated postage meter 40, wherein substrate 100 is manually displaced relative to print head 2 along direction 110. As shown, postage meter 40 includes frame 41 to support upper body 42 and lower body 44. Similar to housing 22 of hand-held postage meter 20, as shown in FIG. 4, upper body 42 includes user interface section 24, print head 2, print head control 4, movement restraining means 6 and sensor 8. The function of the components in upper body 42 is also similar to the function of the components in housing 22, except that movement restraining means 6 in upper body 42 is used to restrict the movement of lower body 44 relative to upper body 42. Preferably, upper body 42 is fixedly mounted to frame 41 and lower body 44 is movably mounted to frame 41. Lower body 44 has registration wall 46, which defines the point where print head 2 starts printing on substrate 100. Lower body 44 further comprises supporting surface 48 to support substrate 100 as substrate 100 is moved into lower body 44. Preferably, substrate 100 is secured or trapped in lower body 44 after it reaches registration wall 46. Subsequently, a user can move lower body 44 along with substrate 100 along direction 110. Sensor 8, in cooperation with movement restraining means 6, restricts the movement of lower body 44 such that lower body 44 is allowed to move by a distance substantially equal to the width of one print line 82 (FIG. 2) after each line is printed. The restriction is removed after last line 84 (FIG. 2) is printed.

Figure 5A:
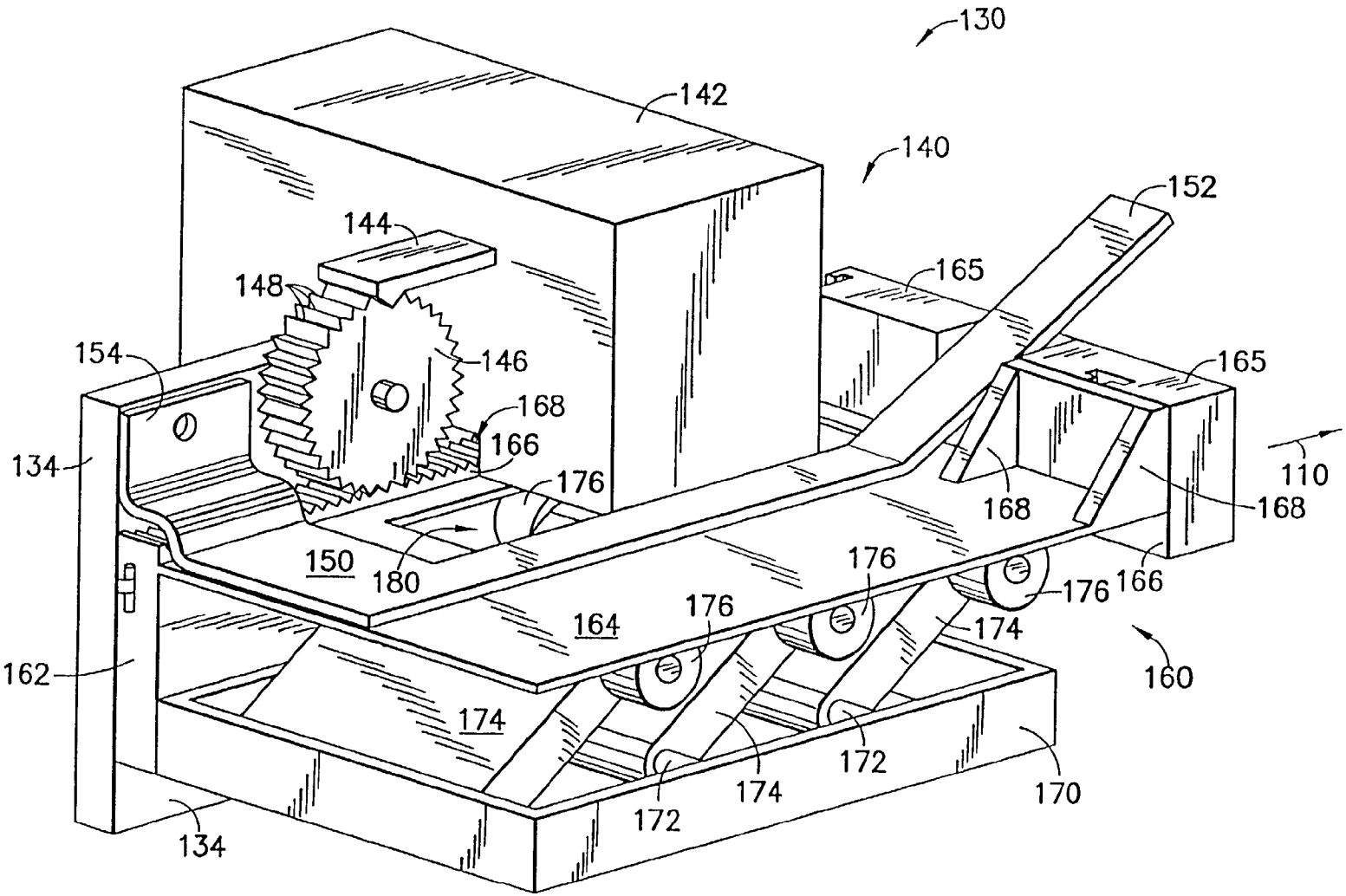
FIG. 5*a* is an isometric representation of an exemplary apparatus for synchronizing the print speed and the manual displacement of the substrate.
Figure 5B:
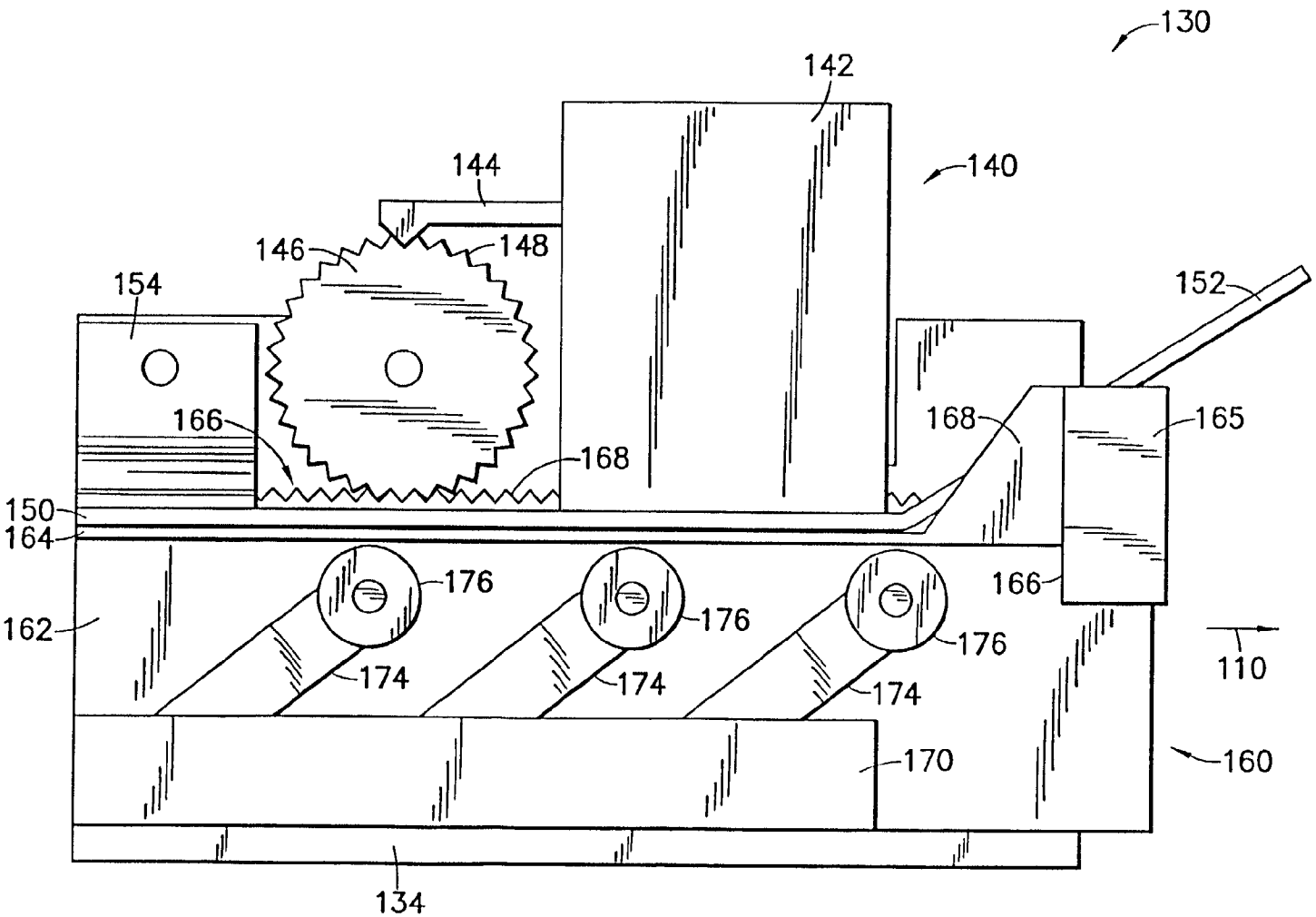
FIG. 5*b* is a side view of the same apparatus.
Figure 5C:
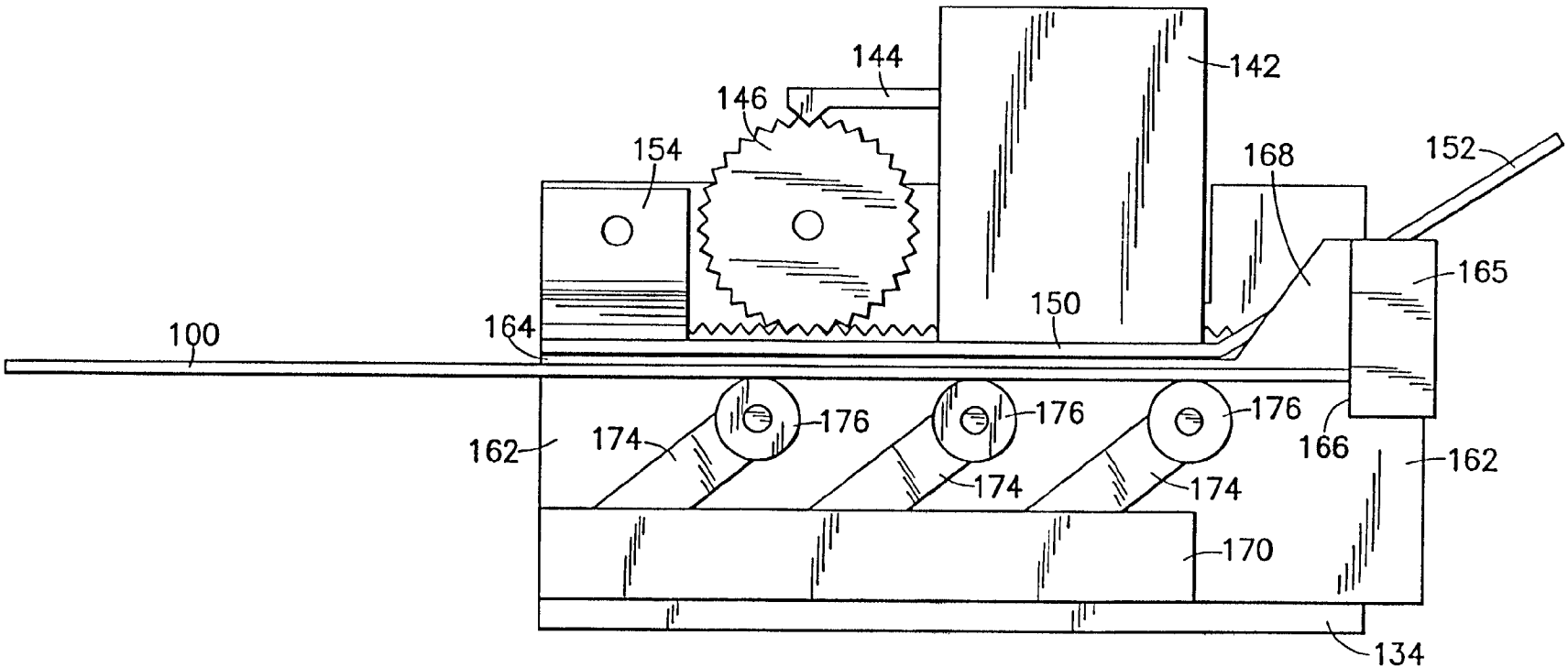
FIG. 5*c* is a side view of the same apparatus showing a substrate being fed into the print zone.
Figure 5D:
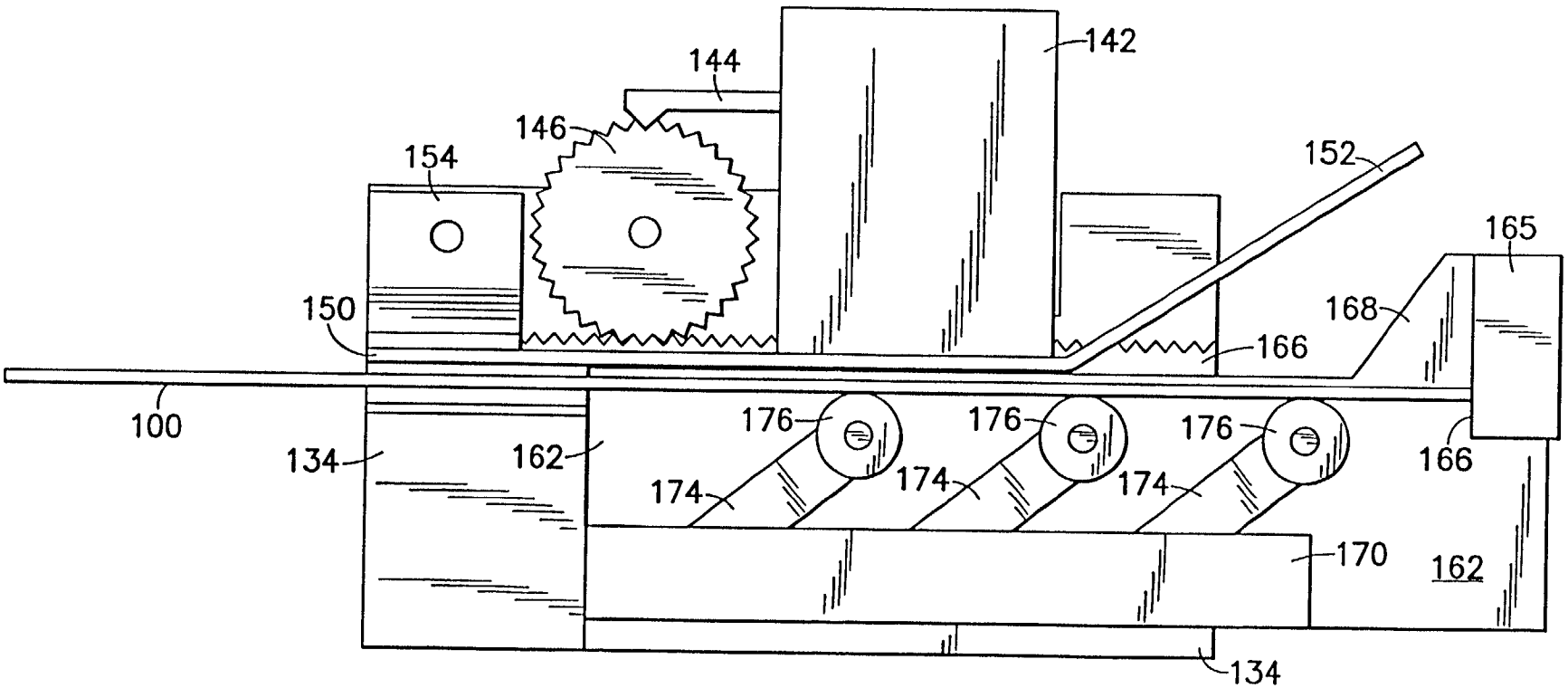
FIG. 5*d* is a side view showing the substrate being moved forward relative to the print head.

An exemplary design of the manually activated postage meter is shown in FIGS. 5*a* to 5*d*. As shown in FIGS. 5*a* and 5*b*, postage meter 130 has frame 134 for fixedly mounting upper body 140, and movably mounting lower body 160 so as to allow lower body 160 to move relative to upper body 140 along direction 110. Upper body 140 includes control box 142 for housing a plurality of components, which are not shown, including print head 2, print head control 4, movement restraining means 6, and sensor 8. Movement restraining means 6 is operatively engaged with latching device 144, which is capable of stopping gear 146 from moving when latching device 144 is lodged between two of the teeth 148. Upper body 140 has plate 150, which is connected to a locking mechanism 154, for fixedly mounting to frame 134. Plate 150 also has restricting end piece 152. The lower body 160 has inner wall 162 movably mounted to frame 134 for linear motion along direction 110. Lower body 160 further includes lower frame 170, which is fixedly mounted to inner wall 162, and upper plate 164 extended from inner wall 162. Lower frame 170 includes a number of shafts 172 for rotatably mounting plurality of roller supports 174. Number of rollers 176 are rotatably mounted on roller supports 174. Rollers 176 allow substrate 100 to be fed into lower body 160 between upper plate 164 and rollers 176, as shown in FIG. 5*c*. Upper plate 164 also has end structure 168 fixedly mounted thereon. End block 165 has vertical wall 166 to serve as a registration wall, which stops substrate 100 when substrate 110 is fed into lower body 160 for printing. As shown in FIG. 5*a*, upper plate 164 has opening 180, allowing print head 2 (not shown) inside control box 142 to print indicium 80 or other image or text on substrate 100. Once substrate 100 is properly fed into lower body 160, the user can move lower body 160 along with substrate 100 along direction 110 for printing. Preferably, roller supports 174 are spring-loaded to provide an upward urging force against substrate 100 for securing substrate 100 between upper plate 164 and rollers 174. The user can push lower body 160 using end structure 168 for moving lower body 160. After the printing is completed, lower body 160 is moved over a certain distance along direction 110, as shown in FIG. 5*d*. Preferably, end block 165 is movably mounted on end structure 168. When the printing is completed, the end block can be moved upward so that substrate 100 can be retrieved from the front end of lower body 160. However, before the printing is completed, restricting end piece 152 prevents end block 165 from being completely displaced upward, as shown in FIGS. 5*a*–5*c*.

Figures 6A, 6B, 6C, 6D, 6E, 6F, 6G:
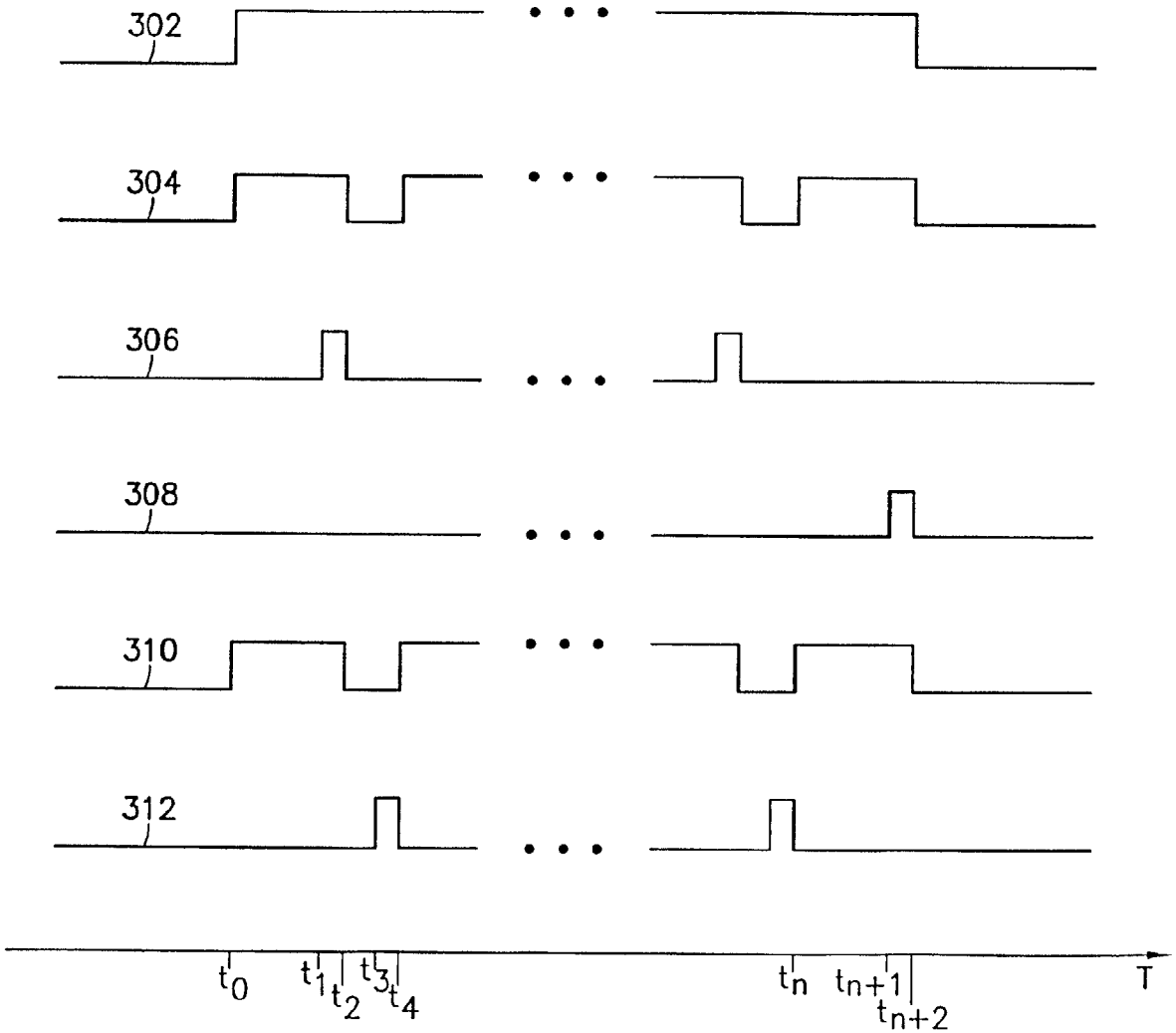
FIGS. 6*a*–6*g* are timing diagrams illustrating the time relationship between the print head, the movement restraining mechanism, and the displacement of the substrate.

FIGS. 6*a*–6*f*are timing diagrams illustrating the time relationship between the print head, the print-head control, the movement restraining means and the sensor in a postage meter, with reference to time axis T, as shown in FIG. 6*g*. As shown in FIG. 6*a*, timing sequence 302 represents the print signal of the postage meter. The printing signal enables the print head at $t=t_0$ after a substrate is properly fed into the postage meter (see FIG. 5*c*, for example). From $t_0$ to $t_2$, the print head prints a line on the substrate, as represented by the first pulse on time sequence 304, as shown in FIG. 6*b*. At the end of the line, the print head control conveys a signal to the movement restraining means, as indicated by the first pulse in time sequence 306 between $t_1$ and $t_2$, as shown in FIG. 6*c*. When print head 2 is printing, the movement restraining means is activated, as indicated by the first pulse on time sequence 310 starting at $t=t_0$, as shown in FIG. 6*e*. The movement restraining means is deactivated at $t_2$. Once the movement restraining means is deactivated, the substrate is allowed to move relative to the print head by a distance substantially equal to the width of a printed line. By then, the sensor activates the movement restraining means, as indicated by the first pulse on time sequence 312 between $t_3$ and $t_4$, as shown in FIG. 6*f*. Subsequently, the print head prints a new line starting at $t_4$, as shown in time sequence 304. The print cycle repeats until the last line is printed. The last line is printed by the print head from $t_n$ to $t_{n+2}$, as shown on time sequence 304. A last line signal, as shown in time sequence 308 of FIG. 6*d*, is provided to override the end of line signal (time sequence 306) between $t_{n+1}$ and $t_{n+2}$. The movement restraining means is not activated again after the last line is printed. The system is reset after a new substrate is fed into the postage meter for printing. The last line signal puts an end to the printing process, as indicated by the negative-going edge at $t_{n+2}$ on time sequence 302.

Figure 7:
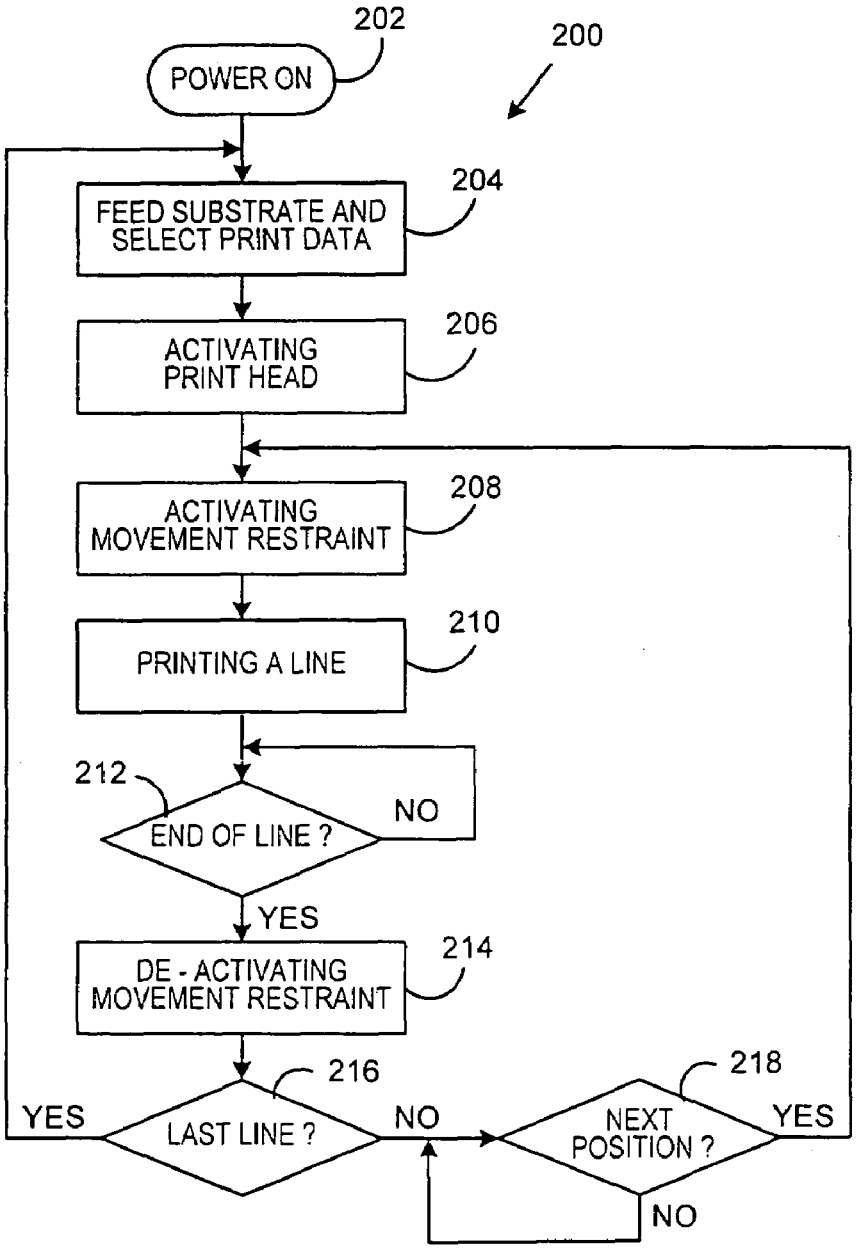
FIG. 7 is a flow chart illustrating the method of synchronizing the print speed and the movement of the substrate, according to the present invention.

The method of synchronizing the print speed of a digital print head and the relative movement of a substrate is illustrated in flow chart 200 of FIG. 7. As shown, the power switch of the postage meter is turned on at step 202. The user is prompted to feed a substrate and to select or type in data for printing at step 204. The print head is activated or enabled at step 206 and the movement restraining means is activated at step 208 to restrict the relative movement between the substrate and the print head. The print head starts printing a line at step 210. When the printed line is completed, i.e., it is the end of the line, as shown at step 212, the movement restraining means is deactivated at step 214. The method will remain at step 212 if it is not the end of the line. If the printed line is not the last line in step 216, the sensor activates the movement restraining means and determines at step 218 if it is at the next position. If it is not at the next position, it will remain in step 218. If it is at the next position, it will go to step 208 to activate the movement restraint. If the printed line is the last line in step 216, the user is prompted to feed a new substrate and to specify the data for printing the new substrate in step 204.

It should be noted that lower body 160 of postage meter 130, as shown in FIGS. 5*a*–5*d*, is designed to be manually advanced. However, lower body 160 can also be moved along direction 110 by a motor, or the like. Thus, the method and apparatus for synchronization, according to the present invention, are also applicable in a postage meter where a movement device is used to move the substrate or the print head.

FIGS. 1–6*g* have been described in regard to a postage meter. However, the synchronization method and apparatus of the present invention can be generally used in a value metering system. The value metering system can be a hand-held system, a counter-top system or other system. The value metering system can be used to print indicia on mailpieces, and can also be used to produce tickets, coupons and the like.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. An apparatus for achieving synchronization in a value metering system using a digital print head capable of printing a plurality of printed lines on a substrate displaced relative to the print head in a moving direction, wherein the lines are substantially perpendicular to the moving direction, and a first signal is provided for indicating a line is printed, said apparatus comprises:

a first mechanism operable at a first position to restrict the displacement of the substrate and a second position to effectively disengage from substrate, wherein the first mechanism is operated at the first position when the print head prints a line;

a second mechanism, responsive to the first signal, for causing the first mechanism to operate at the second position thereby allowing the displacement of the substrate by a predetermined distance relative to the print head for printing a next line; and a third mechanism, responsive to the displacement of the substrate, for providing a second signal, indicative of the displacement of the substrate by the predetermined distance, for causing the print head to print the next line, wherein the third mechanism comprises an optical sensor that restricts the movement of the print head by a distance substantially equal to the width of one print line.

2. The apparatus of claim 1, further comprising a fourth mechanism, responsive to a last line, for providing for preventing the first mechanism from further operating at the first position after the last line is printed.

3. The apparatus of claim 1, wherein the substrate is displaced by a roller, and the first mechanism comprises a latching mechanism operatively connected to the roller for restricting the roller from movement when the first mechanism is operated at the first position.

4. The apparatus of claim 3, wherein the first mechanism further comprises a gear mechanically linked with the roller for movement, and wherein the gear has a plurality of gear teeth and the latching mechanism is capable of engaging the gear teeth for restricting the movement of the gear.

5. The apparatus of claim 1, wherein the value metering system is a counter-top system.

6. The apparatus of claim 1, wherein the value metering system is a hand-held system.

7. The apparatus of claim 1, wherein the substrate is manually displaced.

8. The apparatus of claim 1, wherein the substrate is displaced by a movement device.

9. The method of claim 1, wherein the value metering system comprises a ticket printer.

10. The method of claim 1, wherein the value metering system comprises a coupon printer.

11. The apparatus of claim 1, wherein the value metering system comprises a postage meter.

12. The value-metering system of claim 11, wherein the substrate comprises an envelope for mailing.

13. The value-metering system of claim 11, wherein the substrate comprises a tape for printing an indicium.

14. The value-metering system of claim 11, wherein the print head is adapted to printing an indicium.

15. The value-metering system of claim 11, wherein the print head is adapted to printing an address on the substrate for mailing.

16. The value-metering system of claim 11, wherein the print head is adapted to printing a message on the substrate.

* * * * *